United States Patent [19]

Yuan et al.

[11] Patent Number: 4,848,618

[45] Date of Patent: Jul. 18, 1989

[54] COLLAPSIBLE CONTAINER

[75] Inventors: Chii-Yah Yuan; Tsz-Gang Tswei; Chang-Franw Lee; Wu-Yaw Wei; Ching-Hwa Lin, all of Hsin Chu Hsien; Wen-Kuang Chen, Taipei, all of Taiwan

[73] Assignees: Industrial Technology Research Institute, Hsin Chu Hsien; Wen-Huang Chen, Taipei, both of Taiwan

[21] Appl. No.: 156,016

[22] Filed: Feb. 16, 1988

[51] Int. Cl.[4] ..... B65D 90/66

[52] U.S. Cl. ..... 220/1.5; 220/7; 220/331

[58] Field of Search ..... 220/1.5, 6, 7, 260, 220/331, 350

[56] References Cited

U.S. PATENT DOCUMENTS

| | | | |
|---|---|---|---|
| 3,398,850 | 8/1968 | Kennard | 220/6 |
| 3,765,556 | 10/1973 | Baer | 220/6 |
| 3,941,271 | 3/1976 | Zarges et al. | 220/6 |
| 4,214,669 | 7/1980 | McQuiston | 220/6 |
| 4,577,772 | 3/1986 | Bigliardi | 220/1.5 |
| 4,646,928 | 3/1987 | Ono et al. | 220/6 |
| 4,726,486 | 2/1988 | Masuda | 220/1.5 |

FOREIGN PATENT DOCUMENTS

| | | | |
|---|---|---|---|
| 1007196 | 10/1965 | United Kingdom | 220/6 |

*Primary Examiner*—Jimmy G. Foster

*Attorney, Agent, or Firm*—Cushman, Darby & Cushman

[57] ABSTRACT

A foldable container, of which each of the two side walls has two sections to be foldable inwards so as to have the side walls folded on the floor of the container; the roof of the container is then fallen upon the side walls. Between the roof and the folded side walls, there is a space to accommodate the two end walls; consequently, the container can closely be folded up to facilitate an empty container to be handled in freight. The present invention discloses the fastenable hinges of the side walls and the connecting device of the end walls.

3 Claims, 7 Drawing Sheets

COLLAPSIBLE CONTAINER

BACKGROUND OF THE INVENTION

According to the ISO standards, a freight container mainly comprises four top corner fittings, four corner posts, four bottom corner fittings, a floor, and a roof, and the auxiliary parts such as side walls, end walls and doors. The top corner fittings are the major weight points upon being lifted with a crane at the container pier or at the container yard. The bottom corner fittings are used for support or fixing a container when the same is mounted on a container trailer, or placed on ground, or on the top of another container. Whenever several containers are piled up one over another, the corner posts of the containers are used to bear the total weight of the containers and goods therein. The goods weight of an individual container is supported with the floor, through which the weight is then equally distributed to the four bottom corner fittings. The roof of a container is mainly used for supporting a container operator to work thereon.

As a result of the aforesaid weight-bearing features, a container must have a strong structure. The aforesaid conventional rigid type of container has met the requirements in terms of a strong structure; however, when an empty container is handled for storage or freight, it will take a considerable space, which means a waste of freight space and cost. Recently, a detachable or foldable container has become a design tendency in the container industry.

A known foldable container substantially has no side walls and roof, but it has two end walls (or end frames) to be foldable to the floor. To form a enclosed type off container, it needs detachable side walls and top board. There is another type of container, of which the side walls are foldable, but its roof has to be removed before being folded up. The extreme of a detachable container is to have the walls, the door, the roof and the floor thereof be able to be assembled together respectively, but the assembling and disassembling operation of such a container always needs a special lifting or assembling equipment, that causes additional costs and manual operation inconveniences.

SUMMARY OF THE INVENTION

This invention relates to a foldable container structure, and particularly to an integrally foldable container (not a detachable type).

The primary object of the present invention is to satisfy the aforesaid requirements, i.e., a completely foldable container without detaching any part thereof. A further object of the present invention is to provide a foldable container which can be folded up or unfolded simply by using the lifting equipment available in the container yard. Another object of the present invention is to provide the related parts for folding up the container and operating the end walls thereof.

The foldable container according to the present invention comprise a roof, two foldable side walls, a floor, and two end walls (doors). By means of a pivotal or sliding parts, the end wall and the container body are linked together. The side wall includes three sections, of which the upper section is fixedly attached to the roof of the container. The mid-section, the lower section and the floor are hinged together one after another so as to have the mid-section and the lower section folded on the floor. When the container being folded, the roof falls on the mid-section and the lower section which are folded. There is a space under the roof and between the two upper sections of the side walls for tucking away the end walls at both ends. In the embodiments of the present invention, the upper end of the end wall is pivotally connected with the container so as to have the lower end of the end wall folded into the space under the roof, or is connected with the container in a sliding manner so as to have the end wall slide into the aforesaid space. The end wall may further be furnished with a springing device to reduce the operation weight thereof. The hinged portions of the side walls are provided with fastening means to insure the strong structure after the container being unfolded and assembled in regular form.

When folding or unfolding the container according to the present invention, the roof of the container is to be lifted or lowered only; therefore, the four corner fittings of the container can be operated with a conventional container crane or the like, and it is deemed a novel feature of this invention.

BRIEF DESCRIPTION OF THE DRAWINGS

FIG. 3A illustrates the hinge assembly being fastened in place; FIG. 3B illustrates its two parts being turned at an angle of 90°; FIG. 3C illustrates the two parts being turned at an angle of 180°.

FIG. 4A shows the end wall of the container being recovered inside the container; FIG. 4B shows the end wall of container being pulled out of the container; FIG. 4C shows the end wall of container being put in a position to close the container.

FIG. 5A shows the end wall being recovered inside the container; FIG. 5B shows the end wall being put in a position to close the container.

FIG. 6A shows the end wall being recovered inside the container; FIG. 6B shows the end wall being pulled out of the container and being supported in place with a springing device; FIG. 6C shows the end wall being put in a position to close the container.

FIG. 7A shows the end wall being pulled out; FIG. 7B is a sectional view along line B—B of FIG. 7A; FIG. 7C shows the end wall being put in the closed position.

DETAILED DESCRIPTION

Figure 1:
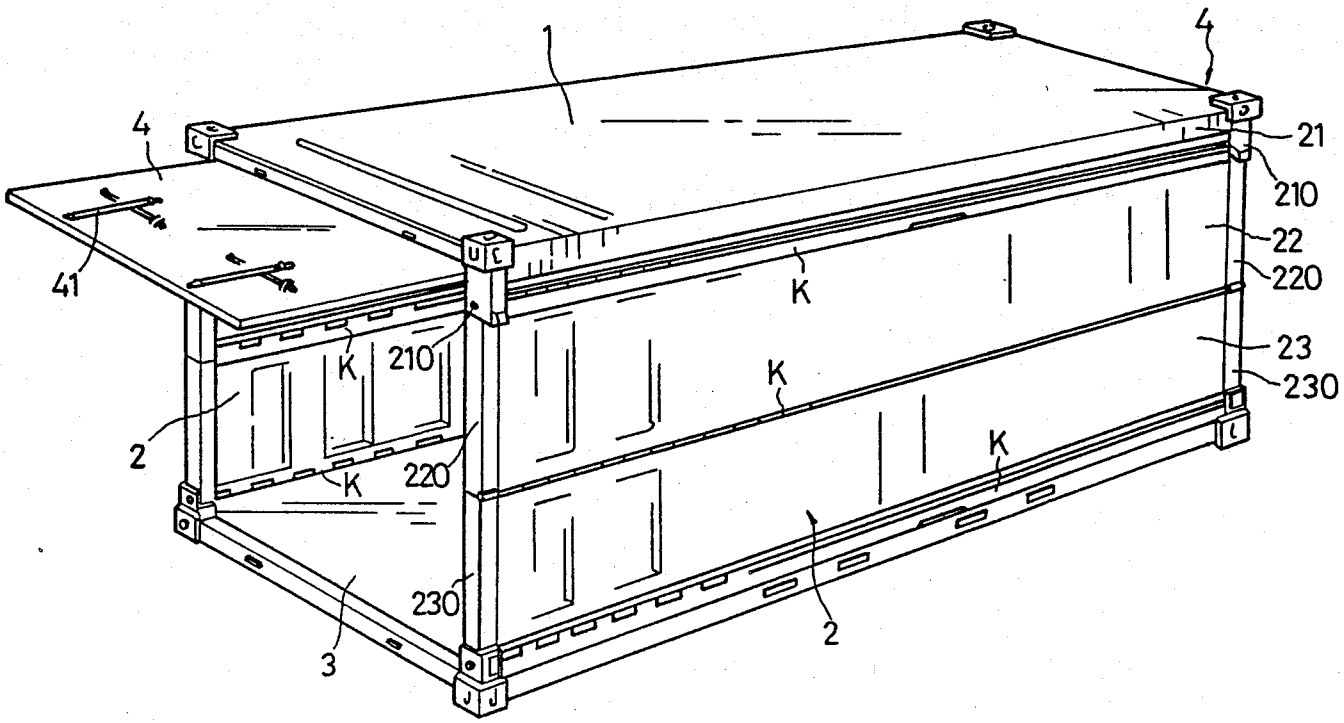
FIG. 1 is a perspective view of a container according to the present invention.

Referring to FIG. 1, there is shown a container according to the present invention, which comprises a roof 1, two side walls 2, a floor 3 and two end walls 4. Each of the side walls 2 includes three sections, i.e., an upper section 21, a mid-section 22, and a lower section 23. The upper section 21 and the roof 1 are fixedly connected together. The three sections 21, 22 and 23 and the floor 3 are connected one another by means of a fastenable hinge K (to be described later), which can have the aforesaid parts turned or fastened in place. Both ends of each of the sections 21, 22 and 23 are furnished with corner posts 210, 220 and 230, being fixed together with the sections respectively. The end wall 4 is connected with the container body by means of a suitable method (to be described later); the lower end of that end wall can be lifted and fixed in a position so as to load or unload goods of the container; the end wall can also be pushed upwards or into the under-roof space of the container body upon the container being folded up. Each of the end walls 4 has a conventional fastening means 41 for fastening the end wall in the container body.

Figure 2:
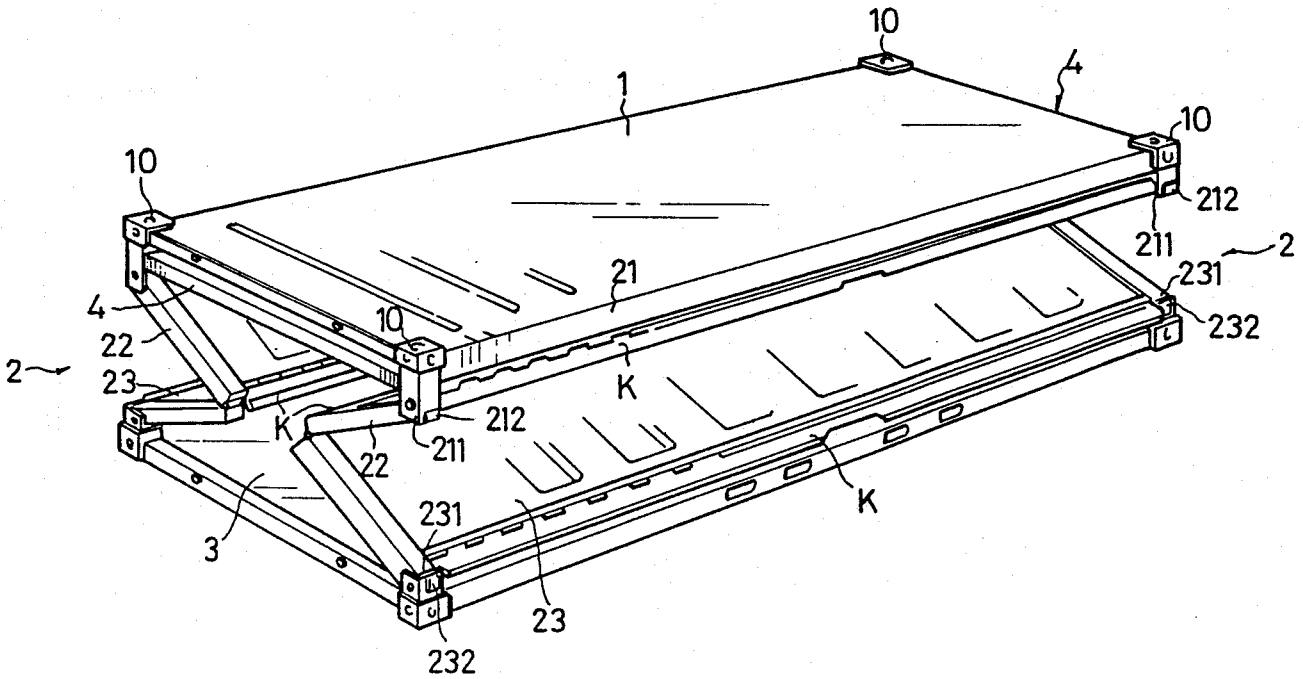
FIG. 2 shows the container according to the present invention being folded.

FIG. 2 shows the container according to the present invention being folded. The two end walls 4 have been tucked into the under-roof space. The six fastenable hinges K of the two side walls have been unfastened into a pivotal state. The four corner fittings 10 on the top of the container are hooked with a container lifting machine (not shown) so as to let the top portion 1 fall downwards with its own weight at a suitable falling speed, and the mid-section 22 and the lower section 23 will be folded into the container body until the corresponding end surfaces 211 and 231 of the corner posts being contacted each other. In that case, the roof 1, the end walls 4, the mid-section 22 and the lower section 23 of the side walls, and the floor 3 are closely folded together. Said contacted portions of the four corner posts, are furnished with fastening means 212 and 232 so as to hold the folded-up container fixedly as one piece. The aforesaid fastening means may be any suitable convention fasteners.

Figure 3A:
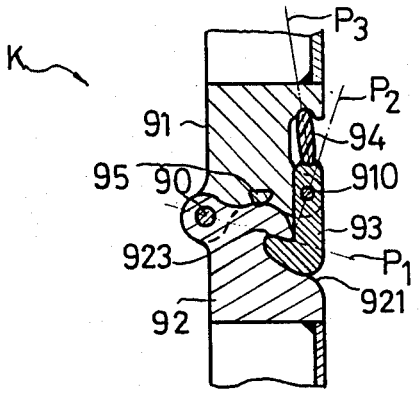
FIGS. 3A to 3C are sectional views, showing the hinge assembly in the side wall of the container.
Figure 3B:
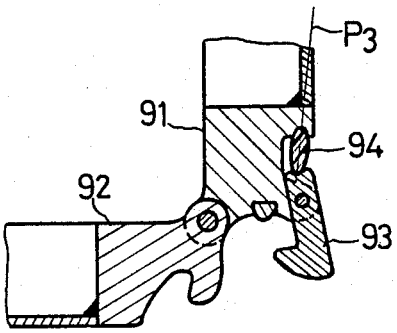
Figure 3C:
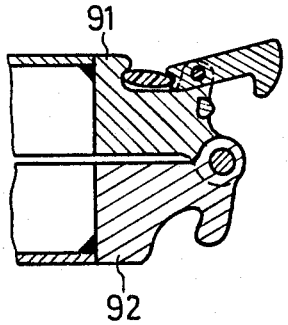

The sectional view of the fastenable hinges K on the side wall and their functions are shown in FIGS. 3A, 3B and 3C. FIG. 3A shows a first pivot 90 which connects a first member 91 and a second member 92 together in a pivotal manner. The first member 91 is mounted with a hook fastener 93 by means of a second pivot 910 on the first member 91, and the hook fastener 93 is to be mated with a hook groove 921 on the second member 92. The mating surface 923 is included in a first plane $P_1$ passing through the center of the pivot 90, and a second plane $P_2$ which is perpendicular to the mating surface 923 will pass through the center of the second pivot 910. After the first member 91 and the second member 92 being fastened together by means of the hook fastener 93, a lock function is provided thereby. Any external force applied to the first and the second members 91 and 92 will be unable to cause the hook fastener 93 to turn except a force that moves the hook fastener 93 out of the hook groove 921. A resilient member 94 is mounted between the first member 91 and the hook fastener 93. The resilient direction $P_3$ (as shown in FIGS. 3A and 3B) is positioned by one side of the second pivot 910 upon the hook fastener 93 being put in the fastened or the unfastened position; in either case, the hook fastener 93 will have a positioning force for fastening or unfastening. Between the first member 91 and the second member 92, there is a sealing member 95 for tightly closing the gap after the two members 91 and 92 being fastened together. As the mechanical means for fastening the hook fastener 93 to prevent it from unintentional unfastening is of ordinary skill, it is not shown in the Figures. FIG. 3B illustrates the two member 91 and 92 being turned around the pivot at an angle of 90° after the hook fastener 93 being un-fastened. As shown in FIG. 2, the 90° of pivotally turning takes place between the upper section 21 and the mid-section 22 of the side wall, and also between the lower section 23 and the floor 3. FIG. 3C illustrates the two members 91 and 92 being turned around the pivot at an angle of 180°, which takes place between the mid-section 22 and the lower section 23 of the side wall.

The operation and structure of the end wall 4 are described in the four embodiments illustrated in FIGS. 4A to 4C, 5A to 5B, 6A to 6C, and 7A to 7C.

Figure 4A:
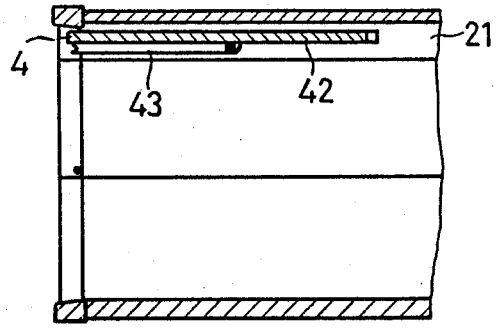
FIGS. 4A to 4C show the first embodiment of the operation and structure of the end wall of the container.
Figure 4B:
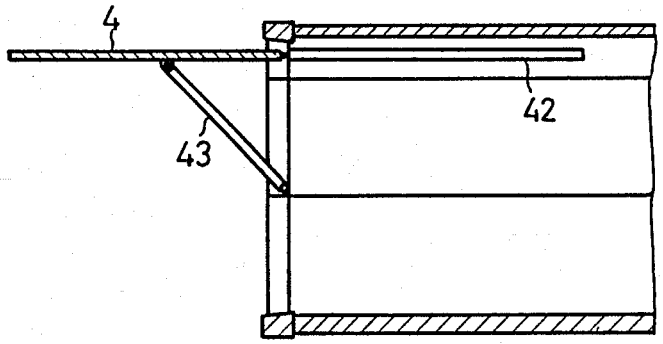
Figure 4C:
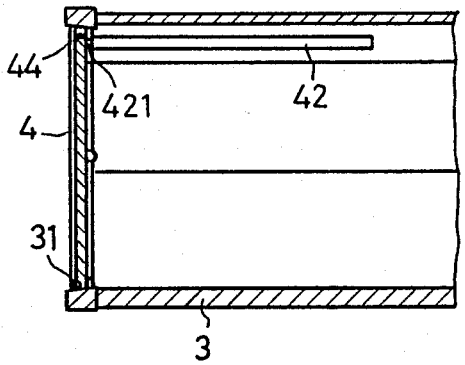

In FIGS. 4A to 4C, the end wall 4 is tucked under the floor (FIG. 4A) of the container by means of rails 42 inside the upper sections 21 of the side walls. The end wall 4 can be pulled out of the rails 42 by pulling the supporting rod 43 so as to pull the end wall downwards to close the container (as shown in FIG. 4C). The end wall 4 may also be supported with the supporting rod 43 mounted on the container body (such as on the corner posts) as shown in FIG. 4B. FIG. 4C illustrates the end wall (having pivots 44 which are slidely mounted in guide grooves 421 connected with the end of the rails 42. The guide grooves for 21 are bent slightly upwards than the level of the rails 42 so as to have the end wall 4 hinged therein. When the end wall 4 is put in the closed position, the oblique outer surface 31 of the floor 3 causes the end wall 4 to move upwards, the pivots 44 then enters into the top of the guide grooves 421, therefore, prevents the upper end of the end wall 4 from moving into the container. The end wall 4 is locked in place with conventional lock means which are not shown.

Figure 5A:
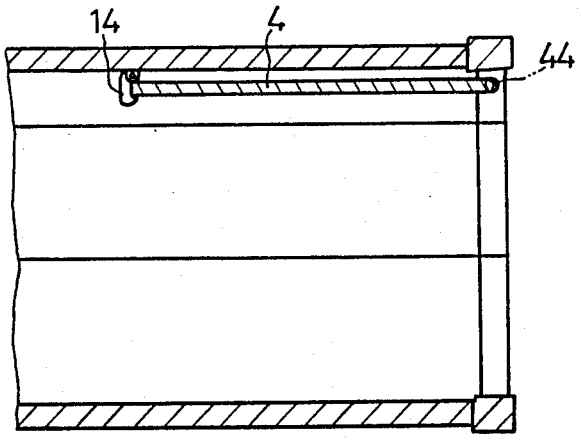
FIGS. 5A and 5B show the second embodiment of the operation and structure of the end wall of the container.
Figure 5B:
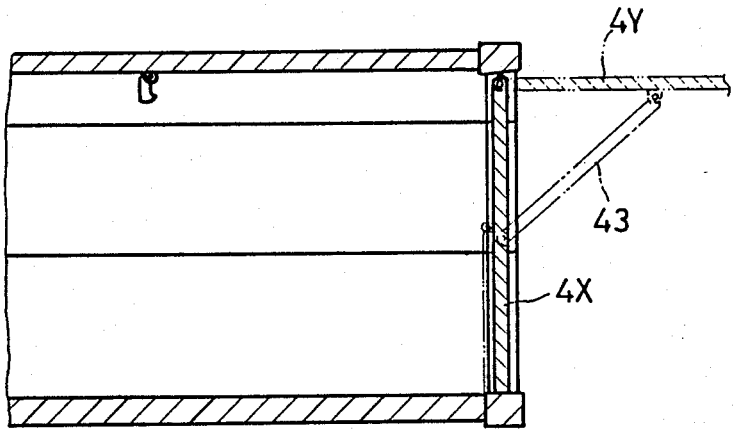

FIGS. 5A and 5B illustrate a second embodiment of the present invention, in which the pivot 44 on the upper end of the end wall 4 is mounted on the top portion of the container, while the lower end of the end wall is turned inside the container, being held in position with a hook 14 (as shown in FIG. 5B). After the hook is unfastened, the end wall will turn and fall to the closed pasition 4X (as shown in FIG. 5B). The end wall may also be mounted with a supporting rod 43 as in the first embodiment and is shown in FIG. 4B so as to support the end wall outside the container at the position 4Y for loading or un-loading goods.

In order to reduce the manual operation load of the heavy end wall, the end wall may further be furnished with a springing device to facilitate the operation.

The embodiment will be described in the following paragraph.

Figure 6A:
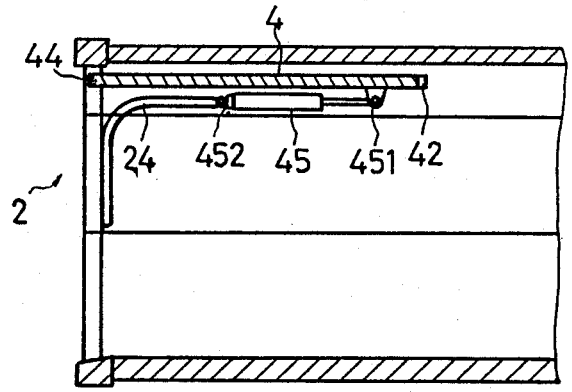
FIGS. 6A to 6C show the third embodiment of the operation and structure of the end wall of the container; the embodiment includes a first springing device.
Figure 6B:
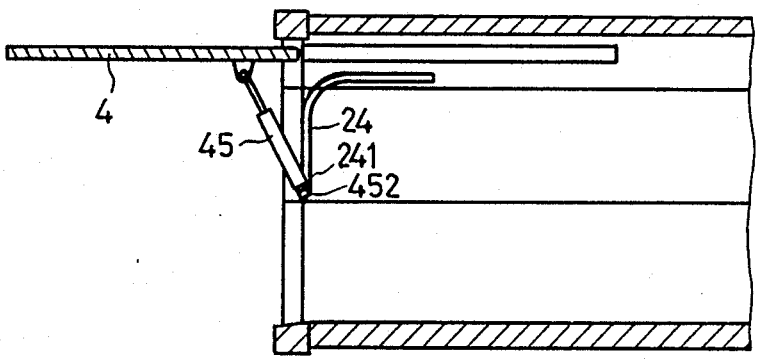
Figure 6C:
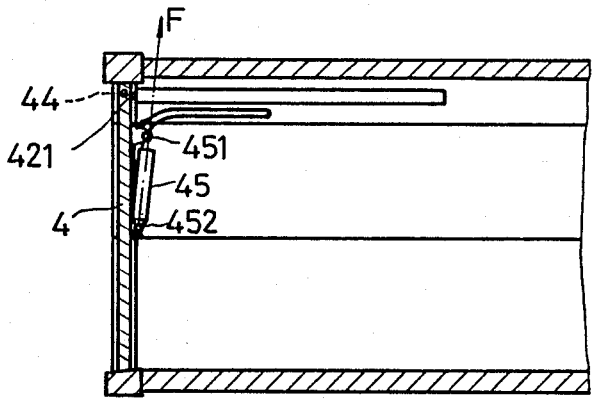

FIGS. 6A to 6C illustrate the operation and structure of the third embodiment according to the present invention, which is furnished with a springing device to facilitate the operation. The operation method of the end wall 4 is similar to the first embodiment (as shown in FIGS. 4A to 4C), i.e., the container includes rails 42, guide grooves 421 and pivots 44, which can facilitate the end wall 4 to be pulled out and turned. The end wall 4 is further furnished with spring members 45 (such as pneumatic resilient device); their front ends 451 are pivotally connected with the end wall 4, while the rear ends 452 are mounted in elbow-shaped sliding grooves 24 provided on the side walls 2. When the end wall 4 is tucked into the container body, the spring members 45 are in the released state (as shown in FIG. 6A). When the end wall 4 is pulled out, the rear ends 452 of the spring members 45 will slide outwards along the sliding grooves 24 until sliding to the bottom ends 241 of the grooves 24; then the spring members 45 are compressed to generate counter force while the end wall 4 is fully pulled out and is supported with the spring members 45, as shown in FIG. 6B. When the end wall 4 is pulled downwards to close the container, the spring members 45 will be compressed further as shown in FIG. 6C. When the end wall 4 is put in the correct closed position, the counter force F generated by the spring members 45 is to directed along a line from the rear ends 452 to the front ends 451, i.e., being biased to the inner side of the end wall pivots 44 to provide a force to cause the lower end of the end wall 4 to move inwards and upwards so as to facilitate the end wall to be fixed in place.

Figure 7A:
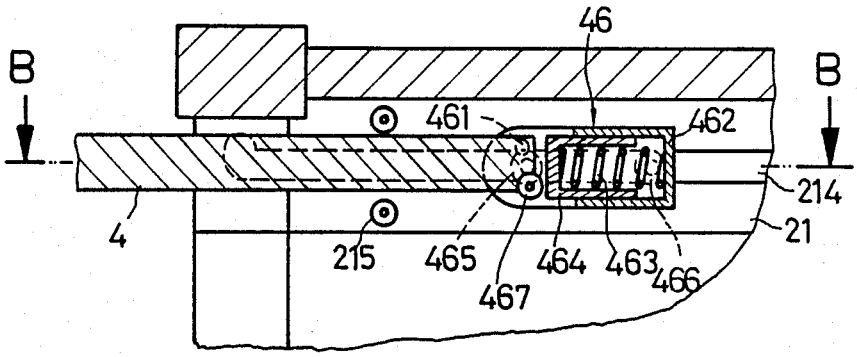
FIGS. 7A to 7C show the fourth embodiment of the operation and structure of the end wall of the container; the end wall is mounted with a second springing device.
Figure 7B:
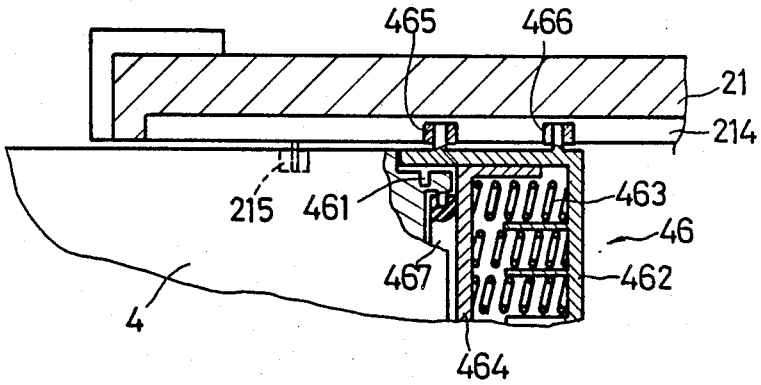
Figure 7C:
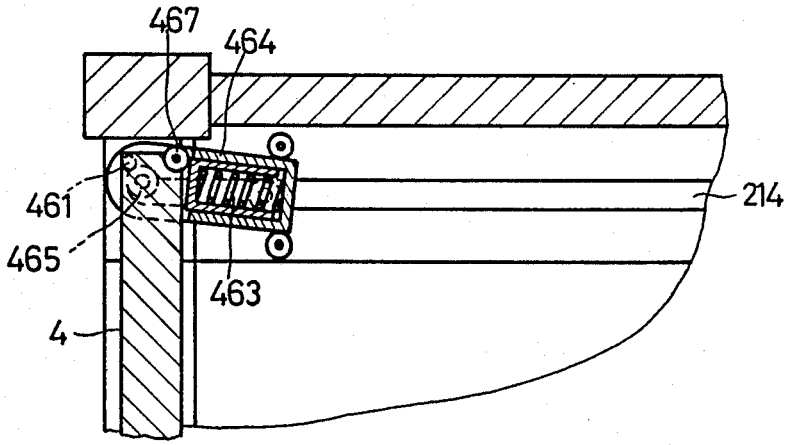

FIGS. 7A to 7C illustrate the operation and structure of the fourth embodiment according to the present invention, which as a second springing device to facilitate the operation of the end wall. FIG. 7A illustrates a vertical sectional view of the second springing device, while FIG. 7B illustrates a horizontal sectional view of the springing device taken along the line B—B of FIG. 7A; it can be seen in the aforesaid two FIGS. that the inner end (the upper end) of the end wall 4 is connected with the springing device 46 by means of pivots 461. The springing device 46 comprises a seat member 462 and a sliding member 464 movable thereon and biased by spring members 463 (such as disk springs or spiral springs as shown in the FIG.). Two sides of the seat member 462 are mounted with rolling wheels 465 and 466, which are slidably attached in the guide channels 214 on the upper sections 21 of the side walls, therefore, the end wall 4 and the spring device 46 can slide along the guide channels 214 and some supporting wheels 215 mounted on the side walls. The inner end of the end wall 4 is furnished with a roller 467 pressing against the sliding member 464. The aforesaid pivots 461 and roller 467 are furnished on the two corners of the inner end of the end wall 4 respectively. When the end wall 4 and the springing device 46 are in the corresponding positions as shown in FIG. 7A, the spring members 463 are under the condition of having less compresson. FIG. 7C illustrates the end wall 4 being turned with the pivots 461 to move downwards. The position change of the roller 467 will, via the sliding member 464, cause the spring members 463 to be compressed further and to store more counter force, which will provide a force upon the end wall 4 being lifted. Since the front end of the guide channels 214 as shown in FIG. 7A are bent upwards, they are helpful to cause the end wall 4 to be caught in position upon the end wall being placed on the oblique outer end of the floor 3 because that the rolling wheels 465 will be force to enter into the bent portions of the guide channels 214 (as shown in FIG. 4C).

The aforesaid two springing devices 45 and 46 are used for describing the sliding type of end wall; however, they may also be used in the pivotal type of end wall described in the second embodiment as shown in FIGS. 5A and 5B, and therefore there will be no details given herein.

Briefly, the container according to the present invention can be folded up completely; the folding or unfolding operation may be done by using a conventional container crane to hold the corner fitting. The folding portions of the side walls have novel fastenable hinges; the end walls of the container are connected with and tucked into the top portion of the container by means of pivotal means or slidably connecting means. The end walls may also be provided with springing devices to facilitate the operation of the end walls. It is deemed that the present invention has a practical value in the industry.

We claim:

1. A foldable container comprising:

a floor having two sides, two ends, and four corner fittings;

two side walls, each having an upper section, a mid-section, and a lower section hinged together; the lower section being hinged to said floor with a fastenable hinge, each of said fastenable hinges including:

a first member and a second member hinged together by a first pivot, which is located at one side of said first and second members so as to let said first and second members turn each other freely;

a third member having one pivotal end pivotally attached to said first member by means of a second pivot opposite said first pivot, and having a hook-shaped end for mating or separating from a hook groove on said second member upon being turned; therefore, said first and said second members can be fixedly fastened together by said third member; the mating surface between said hook shaped end and said hook groove is included in a first plane passing through said first pivot, and a second plane which is perpendicular to said first plane and will pass through said second pivot;

a spring member being mounted between said fist member and a said third member for providing said third member with a biasing force either to the mating or disengaging position;

a roof having two sides and two ends and four corner fittings corresponding to those of said floor, said two sides depending down to fixedly connect with said upper sections of said two side walls respectively defining the top portion of the container;

two ends walls, each having four sides, i.e., top, bottom, left and right sides, for closing the two ends of the container body that is made with said floor, said side walls, and said roof; and connecting devices to have said end walls connected with said container body so as to let said end walls move freely to close said container and to tuck away into the upper portion of said container body; and when the hinge portions of said side walls being put in moveable state and said two ends walls being in tucked position, said container can be picked up by means of a conventional container crane by hooking said four corner fittings so as to fold said mid-section and said lower section in to said container, and finally said roof, said end walls, said side walls, and said floor being folded closely together.

2. A foldable container structure as claimed in claim 1, wherein the connecting device between said end wall and said container body includes:

pivot means being furnished at the upper left and right sides of said end wall and the outer end of said upper portion of said container body for allowing said end wall to be turned to the closed position or lifted up in a horizontal position outside said container;

guiding means being furnished on the upper portion of said container body for guiding the said end wall from said outside horizontal position, to slide inside said container body for tucking away;

a springing means for providing a resilient force to support the weight of said end wall so as to assist said end wall to be turned to said horizontal position; said springing means include:

sliding grooves being furnished on each of said side walls, each groove extending vertically up from a starting point then turning to be horizontal until an end point, and spring members each having an upper end and a lower end that can generate a resilient force upon being compressed; said lower end being slidably mounted in said sliding groove, while said upper end being pivotally connected with said end wall at a suitable position; and when said end wall being turned towards said outside horizontal position, said lower ends being position at said starting point, while said upper ends supporting said end wall; and when said end wall being tucked inside said container, said spring member being in a released condition, and said lower end thereof sliding to said end point.

3. A foldable container as claimed in claim 1 wherein the connecting device between said end wall and said container body includes:

pivot means being furnished at the upper left end upper right sides of said end wall and the outer end of said upper portion of said container body for allowing said end wall be able to be turned to the closed position or lifted up at a horizontal position outside said container;

guiding means being furnished on the upper portion of said container body for guiding said end wall from said outside horizontal position, to slide inside said container body for tucking away; and spring means being pivotally connected with the top side of said end wall and with the upper portion of said container body for facilitating the pivotal movement of said end wall between the tucking-away position and the closed position; said spring means having springs to generate a counter force upon being compressed so as to oppose the weight of said end wall, and to provide a lifting force for assisting said end wall to be turned upwards from the closed position.

* * * * *